United States Patent [19]

Chen

[11] Patent Number: 5,058,498

[45] Date of Patent: Oct. 22, 1991

[54] STRUCTURE OF ALUMINUM CAN CRUSHER

[76] Inventor: John Chen, 142-1, Lane 211, Chung Yang Rd., Lung Ching Hsiang, Taichung Hsien, Taiwan

[21] Appl. No.: 615,855

[22] Filed: Nov. 20, 1990

[51] Int. Cl.[5] ..... B30B 1/22; B30B 9/32

[52] U.S. Cl. ..... 100/288; 100/245; 100/902

[58] Field of Search ..... 100/245, 281, 283, 293, 100/902, 288

[56] References Cited

U.S. PATENT DOCUMENTS 4,197,796 4/1980 Salatka ..... 100/293
4,334,469 6/1982 Tanner ..... 100/288
4,345,519 8/1982 Sabino ..... 100/902
4,498,385 2/1985 Manley ..... 100/293

*Primary Examiner*—Philip R. Coe
*Assistant Examiner*—Randall Chin
*Attorney, Agent, or Firm*—Wenderoth, Lind & Ponack

[57] ABSTRACT

An aluminum can crusher of the type having a driving gear mounted on a movable axle, which is transversely disposed inside a housing, and engaged with a gear rack on the back of the vertical surface portion of a substantially L-shaped crushing plate. A substantially U-shaped handle is coupled to the movable axle to carry it to rotate. Lowering the handle causes the driving gear to move the crushing plate downward against the base of the housing for crushing an interposed aluminum can.

3 Claims, 6 Drawing Sheets

STRUCTURE OF ALUMINUM CAN CRUSHER

BACKGROUND OF THE INVENTION

1. Field of the Invention

This invention relates to aluminum can crushers, and more particularly to an aluminum can crusher of the type having a driving gear engaged with a gear rack and controlled by a handle to drive a crushing plate to slide inside a housing for crushing aluminum cans, by means of the guidance of two opposite pairs of parallel rails.

2. Description of the Prior Art

Empty aluminum cans shall have to be crushed before disposal, so as not to occupy much space. For doing this job, various aluminum can crushers have been disclosed. U.S. Pat. No. 4,197,796 disclosed a compactor for crushing aluminum containers, in which a crushing plate is coupled to a handle for crushing aluminum container against a stationary plate. In U.S. Pat. No. 4,062,283, there is disclosed a beverage can crusher, having a rectangular housing, a ram mounted inside the housing and controlled by a lever arm to slide within the housing. These two structures of equipment are commonly designed for crushing aluminum cans through lever motion. However, these structures occupy much space because an elongated handle is required for saving the labor.

SUMMARY OF THE INVENTION

The present invention has been accomplished to eliminate the aforesaid problems. It is therefore an object of the present invention to provide an aluminum can crusher which is easy to operate. It is another object of the present invention to provide an aluminum can crusher which does not occupy much space. To achieve these objects, there is provided an aluminum can crusher having a driving gear engaged with a gear rack which is mounted on a crushing plate. By lowering a short handle, the driving gear is caused to carry the crusher to slide downward within a housing, so as to crush an aluminum can mounted on the topmost edge of the base of the housing.

DETAILED DESCRIPTION OF THE PREFERRED EMBODIMENT

Figure 1:
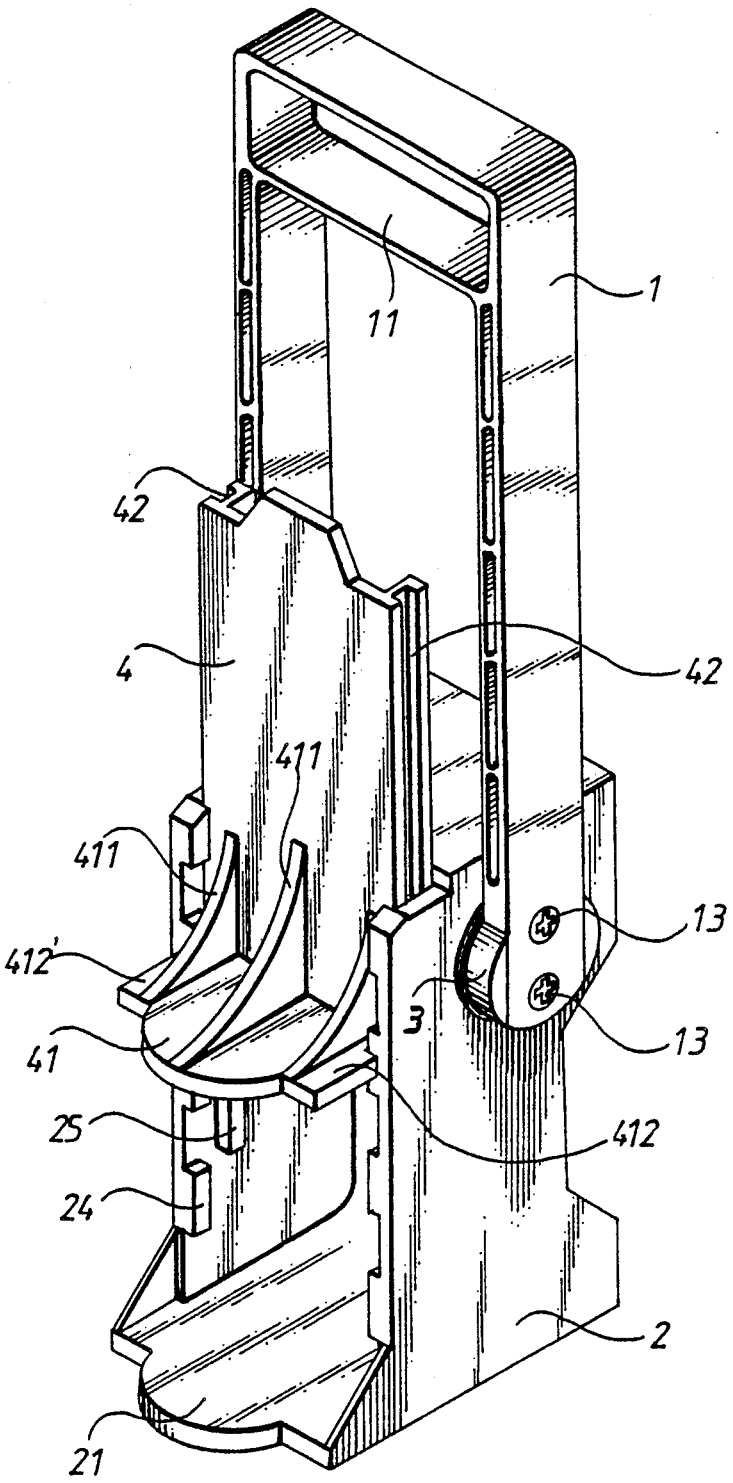
FIG. 1 is a perspective assembly view of the preferred embodiment of the present invention.
Figure 2:
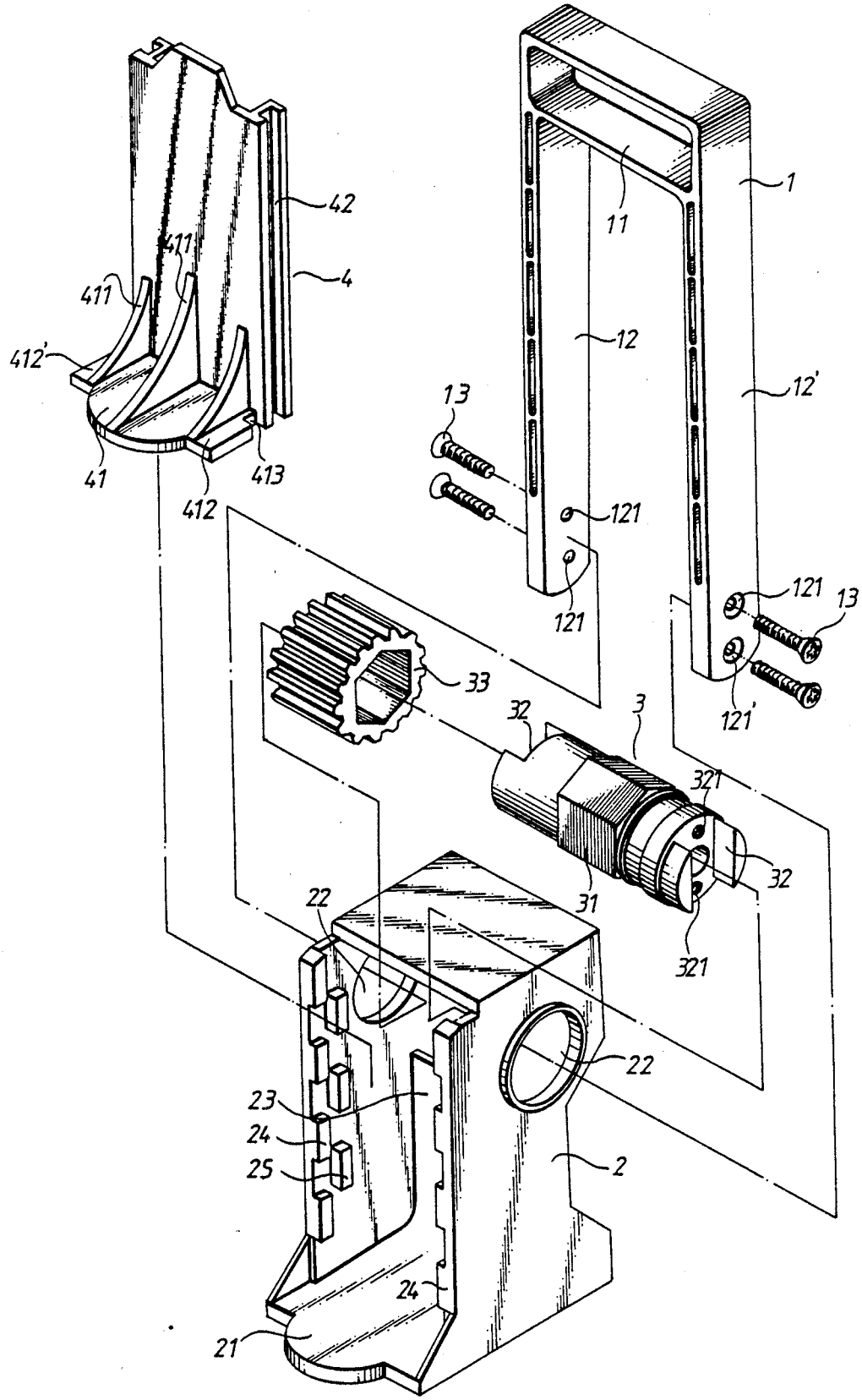
FIG. 2 is a perspective dismantled view of the preferred embodiment of the present invention.

Referring to FIGS. 1 and 2, there is illustrated an aluminum can crusher embodying the present invention and generally comprised of handle 1, housing 2, movable axle 3 and crushing plate 4.

The handle 1 is designed in a substantially U-shaped configuration structurally reinforced by a unitary cross bar 11, making it easy for holding of the hand. The two opposite side bar portions 12, 12' of the handle 1 have each a smooth, circular terminal end, and at least a through-hole 121 or 121' for securing the movable axle 3 by screw bolt 13.

The housing 2 is substantially shaped like a rectangular frame, having a flat front extension 21 transversely extending from the base thereof for mounting the aluminum can to be crushed, two circular mounting holes 22 respectively made on the two opposite side walls thereof and axially aligned with each other, a stop wall 23 upstanding from the base thereof and spaced away from said front extension 21, a pair of parallel rails 24 and 25 each respectively longitudinally made on the inner side of said two opposite side walls. The two parallel rails 24 and 25 on each of said two opposite side walls are properly spaced from each other at a constant range, of which each can be a solid rail, or a rail comprised of a plurality of parts spaced from one another and longitudinally aligned (as in the example of the preferred embodiment shown in the drawing).

The movable axle 3 has a polygonal collar 31 at the middle for mounting a polygonal driving gear 33, two symmetrical journals respectively extending from said polygonal collar 31 at two opposite ends, and two notched terminal ends 32 respectively fastened in the two opposite, circular mounting holes 22 of the housing 2. The two notches terminal ends 32 of the movable axle 3 have each at least a bolt hole 321 made thereon for mounting the handle 1.

Figure 3:
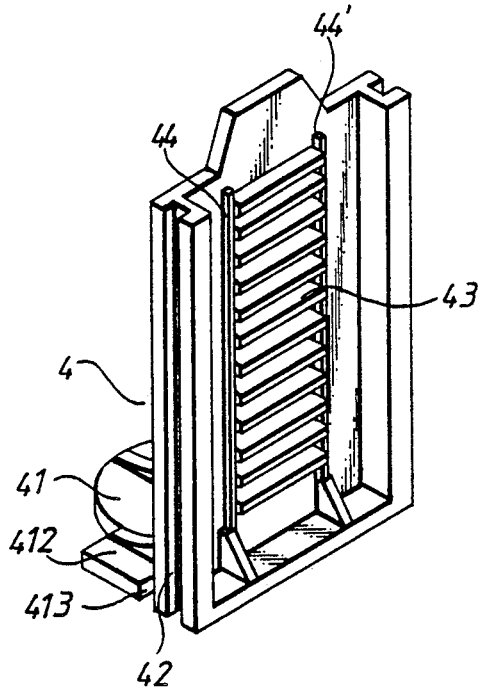
FIG. 3 is a perspective back view of the crushing plate.

The crushing plate 4 is a flat plate of suitable thickness, having two guide slots 42 at two opposite side edges, two parallel stop bars 44, 44' on the back and defining therebetween a gear rack 43 (see FIG. 3), and a crushing surface 41 vertically extending therefrom at the bottom and supported by a plurality of reinforcing ribs 411. The crushing surface 41 is designed to match with the front extension 21 of the base of the housing 2 for crushing aluminum cans, having two projecting strips 412, 412' bilaterally transversely extending outward therefrom each of which having a notch 413 at one side.

Figure 4:
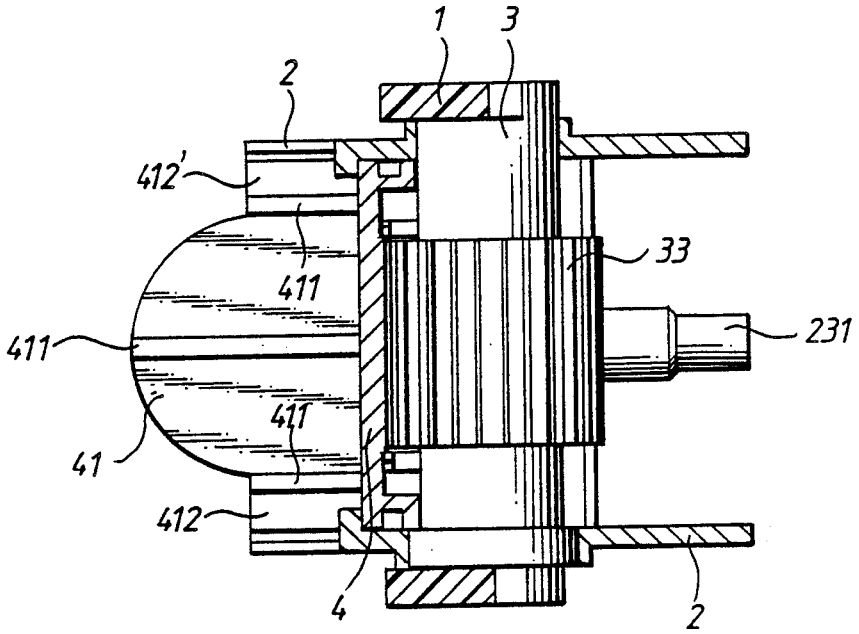
FIG. 4 is a cross sectional view of the preferred embodiment of the present invention.
Figure 5:
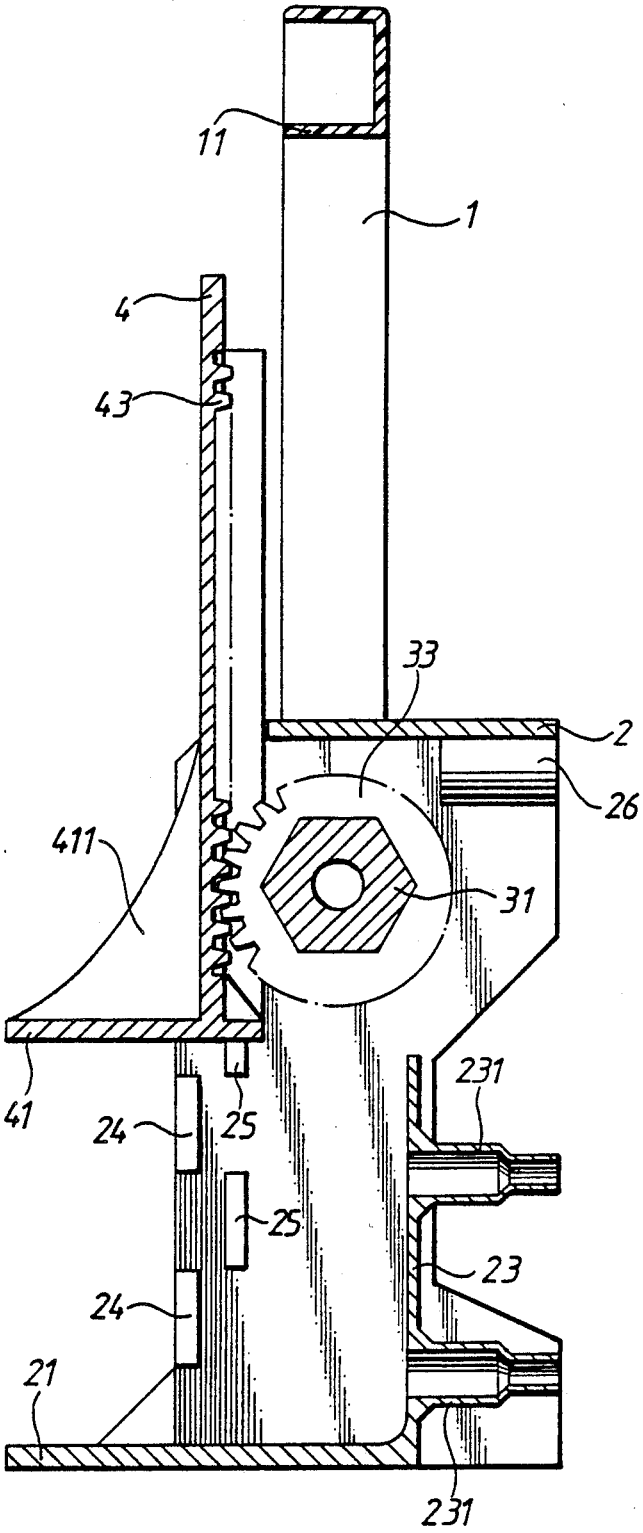
FIG. 5 is a sectional elevational view of the preferred embodiment of the present invention.
Figure 6:
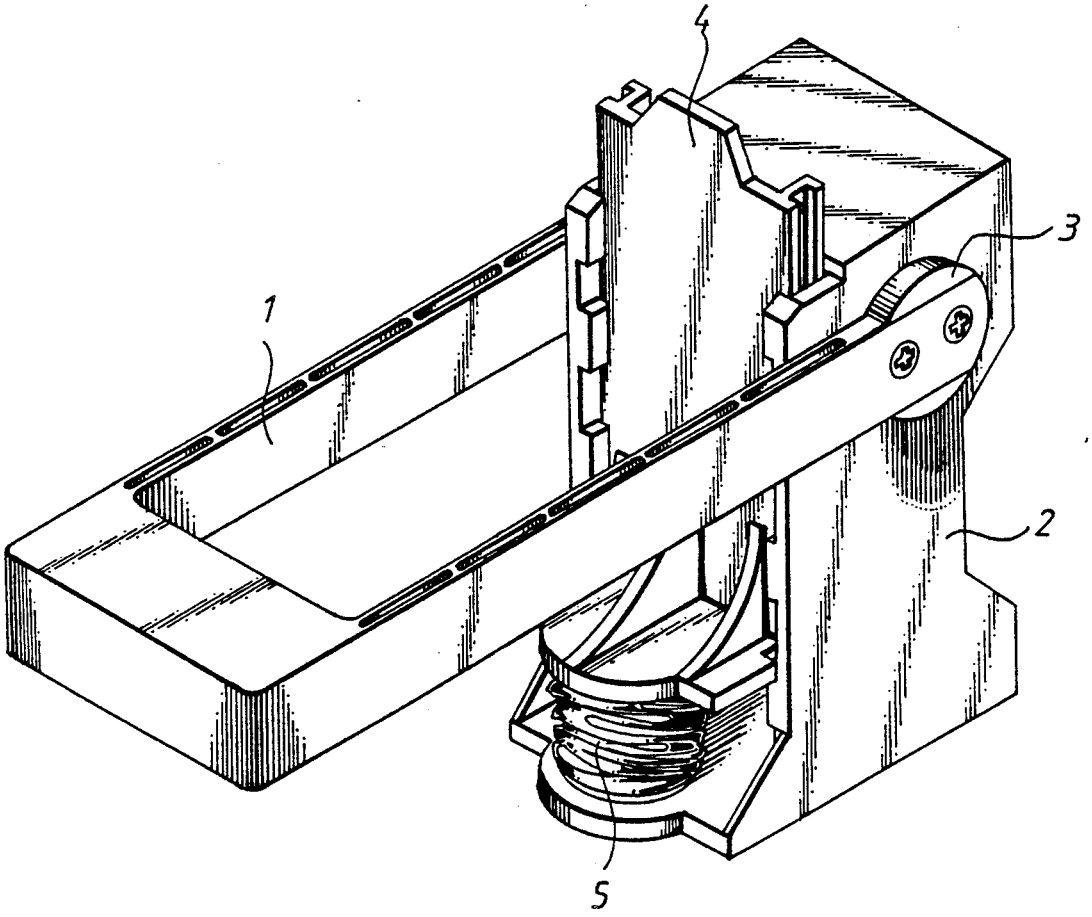
FIG. 6 illustrates an operation of the present invention in crushing an aluminum can (during crushing)
Figure 7:
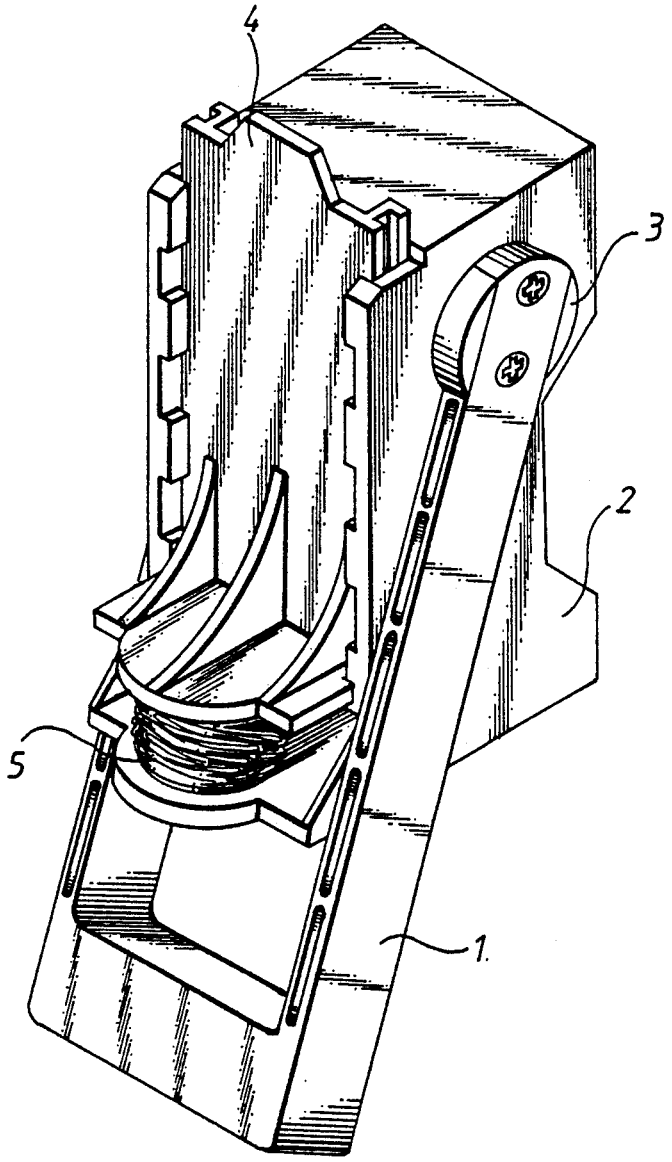
FIG. 7 illustrates an operation of the present invention in crushing an aluminum can (completely crushed).

Referring to FIGS. 4, 5 and 6, after the driving gear 33 is mounted on the movable axle 3, the movable axle 3 is fastened inside the housing 2 and suspended between the two opposite circular mounting holes 22 of the housing 2. Then, the two opposite side bar portions 12, 12' of the handle 1 are respectively fastened in the two opposite, notched terminal ends 32 of the movable axle 3 and fixedly secured thereto by screw bolts 13. After the handle 1 is connected to the movable axle 3, the crushing plate 4 is then mounted in the housing 2 with the two opposite notches 413 and the two opposite guide slots 42 respectively slidably engaged with the two opposite pairs of parallel rails 24, 25 of the housing 2, permitting the gear rack 43 to engage with the driving gear 33. After assembly, the present invention can be conveniently operated to crush aluminum cans. Lowering the handle 1 causes the driving gear 33 to drive the crushing plate to move downward, thus squeezing the interposed aluminum can 5 against the front extension 21 of the base of the housing 2 (see FIG. 6). As soon as the handle 1 is lowered to the lower limit, the interposed aluminum can 5 is crushed (see FIG. 7). After the handle 1 is lifted, the crushed can is removed from the housing, and the crushing plate 4 is also lifted for next operation.

Referring to FIG. 5 again, a plurality of unitary, tubular projections 231, 26 may extend backward from the stop wall 23 and the inner top of the housing 2 for mounting in the wall or the flat surface portion of a furniture or some object by screws or other fastening means. Since this is of the known art, it is not included within the scope of the present invention.

I claim:

1. An aluminum can crusher, comprising:

a handle in a substantially U-shaped configuration, having two opposite side bar portions of which each having at least a through-hole made thereon for fastening a screw bolt;

a housing substantially shaped like a rectangular frame comprised of a base, a top and two opposite side walls, having two circular mounting holes respectively made on said two opposite side walls and axially aligned with each other, a stop wall upstanding from said base at an inner side, of said housing, two pairs of parallel rails respectively longitudinally located on said two opposite side of said housing walls at an inner side, said parallel rails of each pair of said two pairs of parallel rails being spaced from each other at a constant range;

a movable axle having two symmetrical journals at two opposite ends and a polygonal collar at the middle of said axle, said symmetrical journals being respectively inserted in said two circular mounting holes and having each at least a bolt hole corresponding to said through-hole for mounting said handle, said polygonal collar having a polygonal driving gear mounted thereon;

a crushing plate having a crushing surface portion transversely extending from a vertical surface portion, said vertical surface portion having two opposite side edges with a two guide slot in each edge and a gear rack aback with thereon, said crushing surface portion having two projecting strips transversely disposed at two opposite sides of said crushing surface and defining therewith two opposite notches; and wherein said handle is connected to the two opposite ends of said movable axle after said movable axle is fastened inside said housing and suspended between said two opposite circular mounting holes, and said crushing plate is mounted in said housing with said two opposite notches and said two opposite guide slots respectively slidably engaged with said two opposite pairs of parallel rails permitting said gear rack to engage with said driving gear, so that said crushing surface portion of said crushing plate can be driven by said handle, via said driving gear, to press against said base of said housing for crushing an interposed aluminum can.

2. The aluminum 1, wherein said parallel rails are each comprised of a plurality of parts spaced from one another and longitudinally aligned.

3. The aluminum can crusher of claim 1, wherein said vertical surface portion of said crushing plate further comprises two parallel stop bars on the back to confine said gear rack therebetween.

* * * * *